United States Patent [19]

Mattesky

[11] Patent Number: 4,970,968

[45] Date of Patent: Nov. 20, 1990

[54] STABILIZED IRONING BOARD

[75] Inventor: Henry Mattesky, Cedar Grove, N.J.

[73] Assignee: Herbert Glatt, Morristown, N.J.

[21] Appl. No.: 462,071

[22] Filed: Jan. 8, 1990

[51] Int. Cl.[5] ..... A47B 3/02

[52] U.S. Cl. ..... 108/117; 248/188.8; 248/188.5; 38/DIG. 2

[58] Field of Search ..... 38/DIG. 1, DIG. 2, DIG. 3; 118/117–118; 248/188.7, 188.8, 188.9, 188.5, 200.1, 616

[56] References Cited

U.S. PATENT DOCUMENTS

| | | | |
|---|---|---|---|
| 2,661,554 | 12/1953 | Siczkiewicz | 38/DIG. 2 |
| 2,908,984 | 10/1959 | Lantz | 108/118 |
| 3,338,539 | 8/1967 | Foster | 248/188.2 |

FOREIGN PATENT DOCUMENTS

| | | | |
|---|---|---|---|
| 1801159 | of 1970 | Fed. Rep. of Germany | 248/188.5 |
| 1213226 | 1/1959 | France | 248/188.5 |

*Primary Examiner*—Kenneth J. Dorner

*Assistant Examiner*—Gerald A. Anderson

*Attorney, Agent, or Firm*—Omri M. Behr

[57] ABSTRACT

An ironing table of adjustable height and adapted to be collapsed during storage comprising a table member of predetermined width having a front leg and a rear leg for supporting said table member connected thereto, together with a means for adjusting the height of said table, a transverse hollow tubular foot member for at least one of said legs is connected to said leg at the outer circumferential surface of said member, at least one hollow tubular sleeve means is located within said foot member and coaxial therewith, a pair of tubular extension members is located within each said foot member and coaxial therewith, wherein a portion of each of said extension members protrudes from the respective end of said foot member and cap members are located on the protruding ends of the extension members. In a preferred embodiment the cross section of the caps is sufficiently large to prevent the "bottoming" of the middle portion of the foot member when pressure is placed on the table.

11 Claims, 1 Drawing Sheet

STABILIZED IRONING BOARD

BACKGROUND OF THE INVENTION

1. Field of the Invention

Collapsible, height adjustable ironing boards.

2. Discussion of the Prior Art

Ironing tables of adjustable height which can be collapsed during storage have been well known for decades. Tables which have been disclosed in the last 20 years generally include a table member of predetermined width, a front leg and a rear leg for supporting the table member connected thereto and a means for adjusting the height of the table. Many inventions have been made directed to the height adjusting means. Typical of these inventions are U.S. Pat. Nos. 2,974,431 and 3,126,875 to Ribaudo, 3,030,716 and 3,039,215 to Boardman 3,152,561 to Munson and 3,151,579 to Steinwedel. In all of these inventions the device further includes a transverse hollow tubular foot member for at least one of said legs wherein one of the legs is connected to the outer circumferential surface of said foot member, at a point proximate to but laterally displaced from the mid-point between the ends of said member. The reason for the lateral displacement will be clear from the illustrations of these inventions. The leg members must be collapsible on either side of the longitudinal axis of the table.

The principle of stabilization by adjustment of the foot member is disclosed in U.S. Pat. No. 3,268,194 to Nielsen. This patent discloses a means for pivoting the foot member in a substantially vertical plane by about 10° and then locking the foot member in that position. A board incorporating this device is marketed under the trade mark "Lady Seymour" with a "spreadfoot" base by Seymour Housewares of Seymour IN 47274. The foot member of this device is substantially U shaped with the open end facing the floor. Extension pieces, of substantially the same shape but slightly narrower, are pivotally connected to the inside of the foot member about 5 cm from each outer end of the foot member. About 2 cm from the ends of the foot members there is a small inwardly directed detent and a small hole in the extension piece a similar distance from the pivot towards its own end. In the storage position the extension pieces are folded into the respective foot members with their ends near the junction of the leg with the foot member. When in use, the extension pieces are folded out to extend beyond the normal width of the board and are locked into position by the interaction of the detents with the respective holes in the extension pieces. The board cannot be used without extending the extension pieces and the amount of extension cannot be varied.

Certain features of height adjustable, collapsible ironing boards have become standard in the trade. These features include the tip to heal length of the table and the width of the table. Further when the table is collapsed the maximum width of the foot members should not exceed the width of the table. The rear foot member should not protrude behind the heel and the from foot member should not protrude in front of the nose. While these are not absolute requirements, most manufactures adhere to them for shipping and point-of-sale convenience.

Ironing boards of the prior art have two problems related to stability. Because of the width constraint no devices have been made whose legs are wider than the table. Thus a theoretically available mode of stabilization has either not been recognized nor, if recognized, been adopted. The second problem relates to the fact that when a vertical force is applied to the table, as happens often with vigorous ironing, there is a tendency to V-shaped distortion at the point of juncture with the leg. Under certain circumstances, i.e. ironing on a solid and hard surface rather than on a padded carpeted surface, the device will tend to wobble due to bottoming at this point.

The second problem has been addressed by two of the above mentioned patents. Boardman U.S. Pat. No. 3,030,716 splits the leg end into a Y shaped format attached to two places on the foot member. This requires complex construction techniques and does not posses the strength of a weld at a single location. Steinwedel raises the cross section of the cap placed at the ends of the foot member with a rotatable cylindrical roller. Steinwedel's approach addresses the second problem but not the first. It would therefore be desireable to construct a board which can solve both aspects of the question of stability.

SUMMARY OF THE INVENTION

There is provided a novel ironing table of adjustable height and adapted to be collapsed during storage comprising: a table member of predetermined width, a front leg and a rear leg for supporting said table member connected thereto, a means for adjusting the height of said table, a transverse hollow tubular foot member for at least one of said legs connected on its outer circumferential surface to said leg, at a point proximate to but laterally displaced from the mid-point between the ends of said member. Tables of the foregoing characteristics are well known.

The novel table of this invention further comprises at least one, suitable two hollow tubular, suitably short, sleeve means located within said foot member and coaxial therewith wherein the outer circumferential surface of said sleeve means is substantially in contact with the inner circumferential surface of said foot member to provide a fairly tight fit.

A pair of tubular extension members is located within each said foot member and coaxial therewith the outer circumferential surface of said extension member is substantially in contact with the inner circumferential surface of said sleeve means, again to provide a tight fit, but one loose enough to allow axial sliding of the extension members with minimal lateral movement. A portion of each of said extension members protrudes from the respective end of said foot member.

A first blocking means, suitably an inward flange, located at each end of said foot members prevents said sleeve member from sliding out of said foot member. A second blocking means, suitably an outward flange, located at the end of each of said extension means distal to the protruding end, interacts with the surrounding sleeve member whereby said extension means is prevented from sliding completely out of said sleeve member.

Finally there is a cap means having a distal, suitably closed end and a proximal end with an opening therein, said opening circumferentially surrounding the protruding ends of said extension members wherein the external cross-sectional diameter of said cap means perpendicular to the axis of the foot member, is at least as great as the maximum external cross-sectional diameter of foot member perpendicular to the axis of the foot member.

Suitably, the cross section is greater than that of the foot member. It is especially desirable if the external cross-sectional radius of said cap means perpendicular to the axis of the foot member, exceeds the maximum external cross-sectional radius of foot member perpendicular to the axis of the foot member by an amount greater than the vertical downward displacement of the locus of connection between the leg and the foot member when a downward force is applied to the surface of the table.

It is further desirable for the cap means to be securely fastened to the protruding ends of the extension members. This may be done either by fastening the cap means to the protruding ends of the extension members by means of an adhesive therebetween or by fastening them to the protruding ends of the extension members by mechanical means, suitably by a spring clip means, preferably one which permits rotation of said cap about the axis of the foot member.

The cross sectional shape of the cap is not critical, however enhanced stability is obtained when the cap means is polygonal in cross section.

In order to comply with accepted packaging standards in the industry it is preferred that the minimum separation of the distal ends of the caps on opposite ends of the same foot member is equal to or less than the maximum width of the table member. It should be noted however that where this separation is less than the maximum width of the table member a reduction of stability occurs.

DETAILED DESCRIPTION OF THE DRAWINGS

Figure 1:
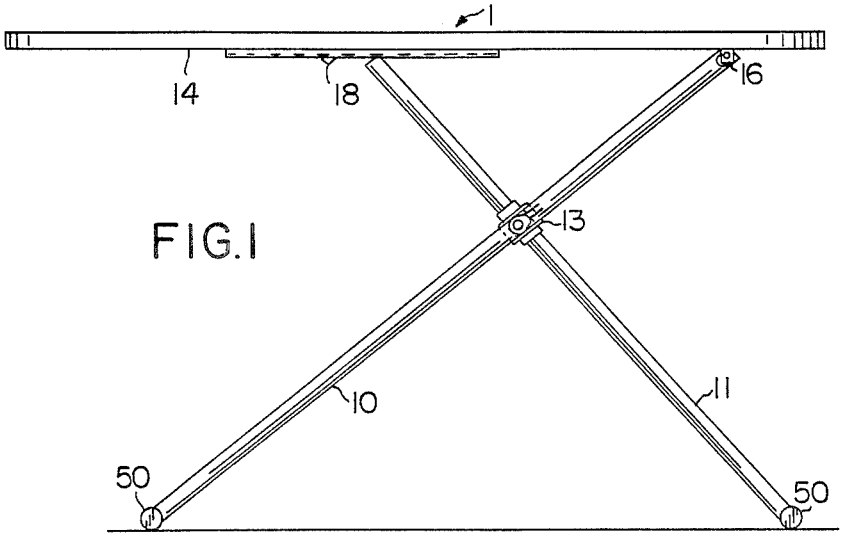
FIG. 1 is a side elevational view of an ironing board of the present invention, said board being shown as erected to medium height.
Figure 2:
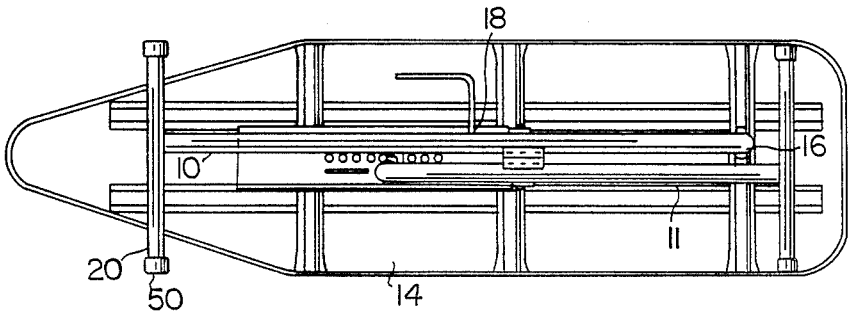
FIG. 2 is a bottom plan view of the board of FIG. 1 in the collapsed state.
Figure 3:
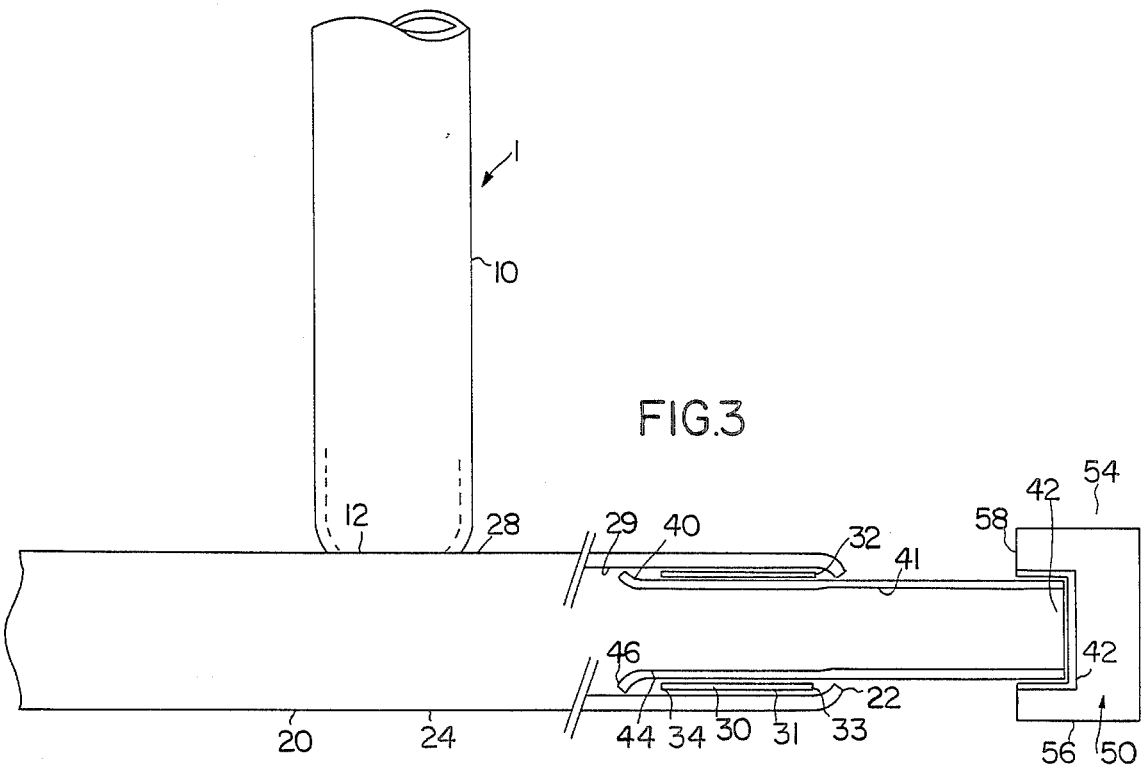
FIG. 3 is cut away partial plan view of a leg and foot portion of the board of FIG. 1.

The ironing table 1, of adjustable height, which is adapted to be collapsed during the storage comprises a table member 14 of predetermined width, a front leg 10 and a rear leg 11 for supporting said table member 14. The top end of front leg 10 is connected to table member 14 directly at pivot point 16, and the upper end of rear leg 11 indirectly, through means 18 for adjusting the height of said table.

Since, in the preferred embodiment, the same structure is present at the bottom of legs 10 and 11, reference will only be had to leg 10. A transverse hollow tubular foot member 20 is, in the preferred embodiment shown, connected at the upper portion 28 of its outer circumferential surface to leg 10, at point 12, a point proximate to but laterally displaced from the mid-point between the ends of said foot member 20. The legs 10 and 11 are pivotally joined at pivot 13.

Two hollow tubular sleeve means 30 are located within said foot member 20 and coaxial therewith wherein the outer circumferential surface 31 of said sleeve means 30 are substantially in contact with the inner circumferential surface 29 of said foot member 20. Only one partial side of a foot member 20 is shown is cut away detail. The structure on the other side is the same.

A pair of tubular extension members 40 are located within each said foot member 20 and coaxial therewith, wherein the outer circumferential surface 41 of each of said extension members is substantially in contact with the inner circumferential surface 33 of the respective sleeve means 30. A portion 43 of each of the extension members protrudes from the respective end of the foot member 20.

A first blocking means, in the form of a flange 22 on the end of a foot member, which is directed towards the axis thereof of, is of sufficient size to prevent exit of the sleeve member 30 from the foot member 20, by interaction with end 32 of sleeve member 30 but does not extend inwardly enough to interfere with reasonably easy axial movement of the extension member 40 within it.

A second blocking means comprises a flange 46 on the non-protruding end 44 of said extension member, which is directed away from the axis thereof and is of sufficient size to prevent complete exit of the extension member 40 from said sleeve member by interaction with end 34 of sleeve member 30.

A cap means 50 having a distal, suitably closed end 52 and an end 58 with an opening 59 therein is located with opening 59 circumferentially surrounding the protruding end 42 of extension member 40. The external cross-sectional diameter of cap means 50 perpendicular to the axis of the foot member 20, that is to say the distance beween uppermost surface 50 and bottom surface 56, is at least as great as, preferably greater then the maximum external cross-sectional diameter of foot member 40, perpendicular to the axis of the foot member 20.

In an especially preferred embodiment the external cross-sectional radius (54–56) of cap means 50 exceeds the maximum external cross-sectional radius of foot member 40 by an amount greater than the vertical downward displacement of the locus of connection 12/24 between the leg 10 and the foot member 20 when a downward force is applied to the surface of the table 14.

While maximum stability is achieved by maximum extension of extension members 40, economics dictate that the collapsed table be as compact as possible for shipping purposes. This it is preferred that the foot members 40 be so dimensioned that the minimum separation of the closed ends 52 of the caps 50 on opposite ends of the same foot member 40 is equal to or less than the maximum width of the table member 14.

I claim:

1. An ironing table of adjustable height and collapsed during storage comprising:

a table memeber of predetermined width having an upper and a lower surface, means for adjusting the height of said table attached to said lower surface, a front leg and a rear leg for supporting said table member connected thereto, one of said legs being pivotally attached to said bottom surface and the other being pivotally attached to said adjusting means.

a transverse hollow tubular foot member for at least one of said legs, connected to said leg at the outer circumferential surface of said member, at a point proximate to but laterally displaced from the mid-point between the ends of said member, at least one hollow tubular sleeve means located within said foot member and coaxial therewith, wherein the outer circumferential surface of said sleeve means is substantially in contact with the inner circumferential surface of said foot member, a pair of tubular extension members located within each said foot member and coaxial therwith wherein the outer circumferential surface of said extension members is substantially in contact with the inner circumferential surface of said sleeve means, wherein a portion of each of said extension members protrudes from the respective end of said foot member, first blocking means located at each end of said foot members prevent said sleeve member from sliding out of said foot member, second block means located at the end of each of said extension means distal to the protruding end thereof interacting with a said sleeve member whereby said extension means is prevented from sliding completely out of said sleeve member and cap means having a distal end and a proximal end with an opening therein, said opening circumferentially surrounding the protruding ends of said extension members wherein the external cross-sectional diameter of said cap means perpendicular to the axis of the foot member, is at least as great as the maximum external cross-sectional diameter of foot member perpendicular to the axis of the foot member.

2. A table of claim 1 wherein the external cross-sectional diameter of said cap means perpendicular to the axis of the foot member exceeds the maximum external cross-sectional diameter of foot member perpendicular to the axis of the foot member.

3. A table of claim 1 wherein the external cross-sectional radius of said cap means perpendicular to the axis of the foot member exceeds the maximum external cross-sectional radius of foot member perpendicular to the axis of the foot member by an amount greater than the vertical downward displacement of the locus of connection between the leg and the foot member when a downward force is applied to the surface of the table.

4. A table of claim 1 wherein each foot member contains two sleeve members.

5. A table of claim 1 wherein the first blocking means comprises a flange on the ends of said foot member directed towards the axis thereof of sufficient size to prevent exit of the sleeve member but not to interfere with said extension member.

6. A table of claim 1 wherein the second blocking means comprises a flange on the non-protruding ends of said extension member directed away from the axis thereof of sufficient size to prevent exit of the extension member from said sleeve member.

7. A table of claim 1 wherein the cap means are securely fastened to the protruding ends of the extension members.

8. A table of claim 7 wherein the cap means are securely fastened to the protruding ends of the extension members by means of an adhesive therebetween.

9. A table of claim 1 wherein the cap means is polygonal in cross section.

10. A table of claim 1 wherein the minimum separation of the distal ends of the caps on opposite ends of the same foot member is equal to or less than the maximum width of the table member.

11. A table of claim 1 wherein the sum of the axial dimensions of a pair of said extension members exceeds the axial dimension of the foot member in which they are located.

* * * * *